US005406049A

United States Patent [19]

Reiser et al.

[11] Patent Number: 5,406,049

[45] **Date of Patent: * Apr. 11, 1995**

[54] FOG-RESISTANT MIRROR ASSEMBLY

[76] Inventors: Carl Reiser, 142 Cider Mill Rd., Glastonbury, Conn. 06033; Richard Sawyer, 5 Trails End Dr., Canton, Conn. 06019

[ * ] Notice: The portion of the term of this patent subsequent to Jan. 21, 2009 has been disclaimed.

[21] Appl. No.: 247,681

[22] Filed: May 23, 1994

Related U.S. Application Data

[63] Continuation-in-part of Ser. No. 819,874, Jan. 13, 1992, Pat. No. 5,347,106, which is a continuation of Ser. No. 367,140, Jun. 16, 1989, Pat. No. 5,083,009.

[51] Int. Cl.[6] ..... H05B 1/00; H05B 3/16

[52] U.S. Cl. ..... 219/219; 219/522; 219/543

[58] Field of Search ..... 219/219, 213, 522, 543, 219/528, 529, 549, 501

[56] References Cited

U.S. PATENT DOCUMENTS

| | | | |
|---|---|---|---|
| 3,790,748 | 2/1974 | Van Laetham | 219/219 |
| 4,352,006 | 9/1982 | Zega | 219/219 |
| 5,083,009 | 1/1992 | Reiser et al. | 219/219 |
| 5,347,106 | 9/1994 | Reiser et al. | 219/219 |

*Primary Examiner*—Bruce A. Reynolds
*Assistant Examiner*—Michael D. Switzer
*Attorney, Agent, or Firm*—William W. Jones

[57] ABSTRACT

The mirror assembly uses a non-reflective conductive coating as a heating element for preventing fog formation on a mirror exposed to a humid environment such as is found in a bathroom. As compared to conductive reflective mirror coatings, the non-reflective conductive coatings used in this invention have a relatively high resistance, which allows high reflectivity mirrors to be made fog-free. The conductive coatings may be split into separate conductive elements with one or more scribe lines in order to control the length of the conductive path from inlet bus to outlet bus. The buses may be made from an ultra thin foil tape, which can be adhered to the conductive coatings, and which is solderable for securement of power lines thereto. Such a bus tape possesses both in plane and through plane conductive characteristics and can easily be cut to any length desired for the mirror sizes being produced. Highly conductive plated layers may be deposited on the conductive surfaces where the foil buses are attached to enhance the contact between the buses and the conductive mirror surfaces. The foil buses are connected to electrical conductor wires from the power source.

11 Claims, 2 Drawing Sheets

FOG-RESISTANT MIRROR ASSEMBLY

This is a continuation-in-part of U.S. Ser. No. 07/819,874, filed Jan. 13, 1992, now U.S. Pat. No. 5,347,106, which is a continuation of U.S. Ser. No. 07/367,140, filed Jun. 16, 1989, now U.S. Pat. No. 5,083,009, which is incorporated herein in its entirety for purposes of identifying background art for this invention.

TECHNICAL FIELD

This invention relates to prevention of fog formation, or quick removal thereof, from a bathroom mirror. The invention includes both a heater and control system designed to quickly heat a cool mirror to a temperature high enough to remove any existing fog and prevent further condensation, while not allowing the mirror surface temperature to become uncomfortably warm to the touch (about 110 degrees to 120 degrees F.).

DESCRIPTION OF THE INVENTION

For installations requiring high reflectivity, a commercially available product known widely as E glass (low emisivity glass) is used in the mirror assembly. This product is presently used as window glass and has a microscopic layer of tin oxide applied to one surface thereof. This product is not itself reflective, but it can be laminated to the rear side of a highly reflective mirror, with its tin oxide-coated surface being disposed adjacent to the mirror so as to produce a non-reflective, rapidly heated surface in the mirror assembly.

The high reflectivity mirror assembly described herein uses currently available mass produced materials which include conventional coated window glass and conventional widely available mirror glass compatible with conventional mirror installation techniques. The assembly complies with applicable electrical safety codes. These materials can be manufactured economically for application to any of a very wide range of mirror sizes.

A typical scenario for fog formation on a bathroom mirror is one where a person enters the bathroom, closes the door, enters the shower, and turns on the water, regulated to a typical temperature of 120 to 130 degrees F. The shower water raises the air temperature in the room 16 to 20 degrees F. and the humidity to near 100%, resulting in condensation on all of the surfaces in the room below this temperature, including the mirror surfaces. This condensation results in fogging of the mirror's reflective images.

To prevent the condensation, the mirror surface temperature must exceed the air temperature at all times. This means that :the heater used to raise the mirror temperature must heat the mirror at a rate exceeding the air temperature increase which is driven by the shower water temperature.

Experiments have shown that for most bathrooms this rate does not exceed 1,5 degrees F./Min.. The heater power level required to exceed this rate is approximately 20 watts/ft$^2$ for one-eighth inch thick glass mirrors, and approximately 35 watts/ft$^2$ for one-quarter inch thick glass mirrors. Both sizes are used as bathroom mirrors; however, the one-quarter inch thickness is the more popular size. The 20 watt/ft$^2$ heater results in a 30 degree F. total temperature rise. When this temperature increase is added to a maximum typical starting bathroom temperature of 80 degrees F., the resulting 110 degrees F. is still below the comfortable-to-the-touch temperature limit. However, the 35 watt/ft$^2$ heater results in a 40 degree F. total temperature rise which can be uncomfortable to the touch at 120 degrees F.. To prevent reaching this temperature range, a control system is used which runs the heater at full power for 7 to 8 minutes and then switches to half power and maintains this setting until the circuit is de-energized. At that time the mirror temperature has increased approximately 12 degrees F. and the room temperature by less than 10 degrees F.. By that time, the room temperature rise rate has reduced to less than 1 degree F./Min. which permits the heater power to be reduced by one-half while still assuring that the mirror temperature remains in excess of the room temperature.

The control system disclosed herein is based on a simple inexpensive method of reducing power by half by means of a switch which may be mechanical, electromechanical (as a relay), or electronic. The latter two would be controlled by a timing circuit in the simplest case, or alternatively, a differential temperature sensor could be used.

It is therefore an object of this invention to provide a heated mirror assembly for use in a bathroom operable to prevent fog formation on the mirror when the shower is used in the bathroom.

It is a further object of this invention to provide a heated mirror assembly of the character described wherein heat is provided to the reflective component of the assembly through an electrically conductive non-reflective component therein.

It is an additional object of this invention to provide a heated mirror assembly of the character described wherein heat is provided by flowing electrical current through the conductive component in the mirror assembly It is another object of this invention to provide a heated mirror assembly of the character described wherein the conductive coating is a non-reflective sheet of glass coated with a conductive layer of tin oxide.

It is another object of this invention to provide a mirror assembly of the character described which provides high image reflectivity.

BRIEF DESCRIPTION OF THE DRAWINGS

These and other objects and advantages of the invention will become more readily apparent from the following detailed description of a preferred embodiment thereof when taken in conjunction with the accompanying drawings in which.

DESCRIPTION OF SPECIFIC EMBODIMENTS

The control system runs the mirror at a full power level for approximately seven to eight minutes after first being energized, and then switches to a one-half power level, which half power level is maintained until the mirror is de-energized. The control system includes an integrated circuit which contains a comparator and a zero crossing detector whose output controls a triac. The control circuit operates as follows.

Figure 1:
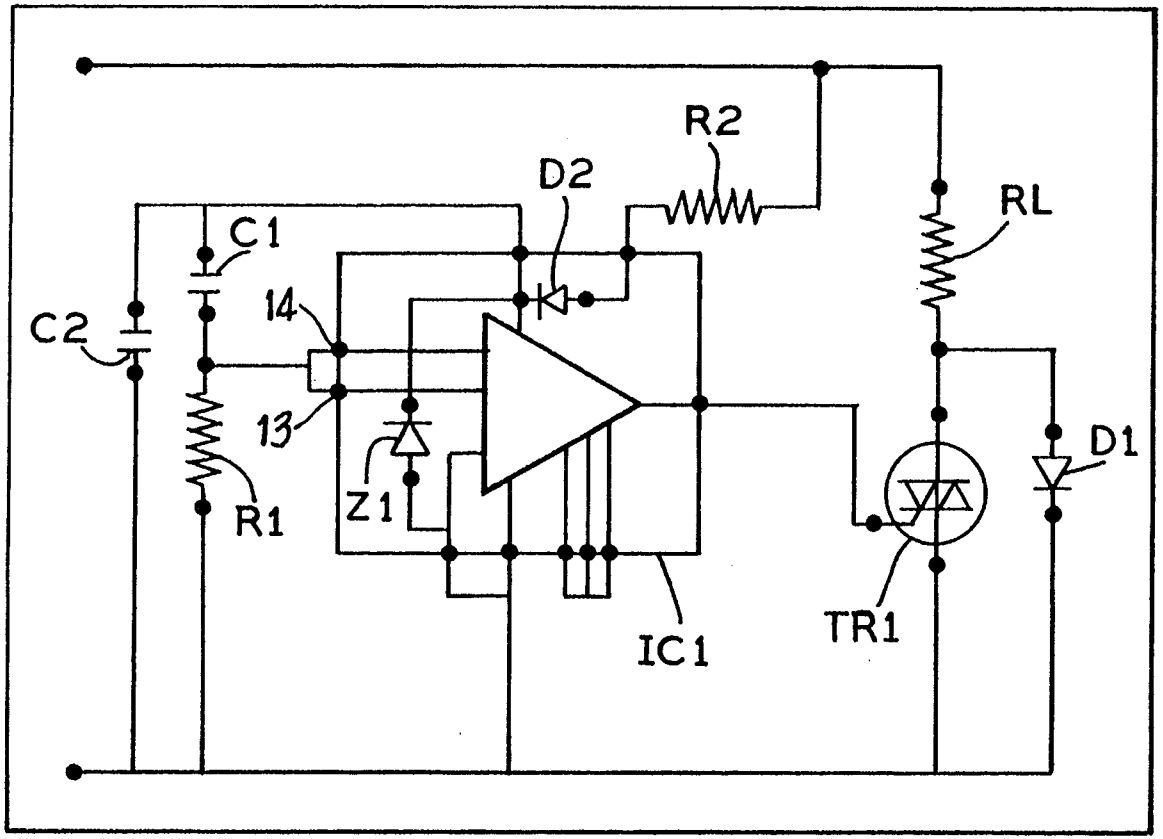
FIG. 1 is a schematic view of the timing and power control circuitry preferred for use with the invention.

Referring to the drawings, there is shown in FIG. 1 a control system which accomplishes the desired timing and power level changes using commercially available semi-conductor devices. Low voltage power for the control circuit, ICI is produced from a 120 Vac line by means of resistor R2, rectifier D2, capacitor C2, and Zener diode Z1. The resistor R2 acts as a current limiter which allows the Zener diode Z1 to regulate voltage to a level close to 5.5 volts. Filtered DC voltage is supplied by diode D2 acting as a half wave rectifier with the filtering provided by capacitor C2. Some integrated circuits of this type contain the rectifier and Zener diodes in the package as shown in FIG. 1.

The duration of full power is determined by the RC time constant of resistor R1 and capacitor C1. When the circuit is initially energized, capacitor C2 is quickly charged to the Zener voltage (Vz) of Z1, resulting in pins 13 and 14 of the circuit ICI being raised to the voltage Vz. This turns on the triac TR1, and the mirror heater RL is driven at full power. Capacitor C2 slowly charges through resistor R1 until the comparator trigger voltage is reached. This trips the comparator and switches the triac TR1 off, leaving only the diode D1 to supply power to the mirror heater RL. Since current is only allowed to flow for positive half cycles of the AC line voltage the mirror is driven at half power. This condition is maintained as long as the AC power is supplied to the circuit.

Typical good quality household mirrors are about one-eighth to one-quarter inch thick. Using a one-eighth or one quarter inch thick high reflective mirror component permits laminating an additional one-eighth inch thick heater component onto the back side of the mirror component for electrical safety protection, which meets applicable safety codes. The resulting one-quarter or three-eighths inch thick mirror assembly closely resembles conventional mirrors in both size and weight and overall appearance. This fulfills the need for the mirror to be compatible with conventional mirror installation techniques. These techniques involve either mounting in decorative frames, onto medicine cabinets, or simply being attached to a flat wall.

The conductive layer of the mirror assembly has a characteristic resistivity. To obtain the required wattage, the distance between the power buses must be determined as a function of the resistivity of the conductive layer. The conductive layer is divided into two or more equal parts, and those parts are joined electrically in series to obtain the desired current path distance. The aforesaid is accomplished by scribing a line down the center of the conductive layer in order to break the electrical continuity between the two adjacent parts of the conductive layer. If the mirror is longer than 3.4 feet then there need not be a scribe line through the heating element. The use of separate tin oxide-coated glass component as the heating element allows the invention to be used in conjunction with low resistivity highly reflective materials, ie, materials such as silver that reflect about 90% of the light reaching the mirror, which materials could not serve as a heating element since the required current path length between buses would be unduly long. Providing the necessary current path length in a typical bathroom mirror where the heater surface is the reflective layer made of silver, or another high reflective material, would require the use of an undesirably large number of scribe lines. The use of a separate conductive layer which is not the reflective layer solves this problem.

Figure 2:
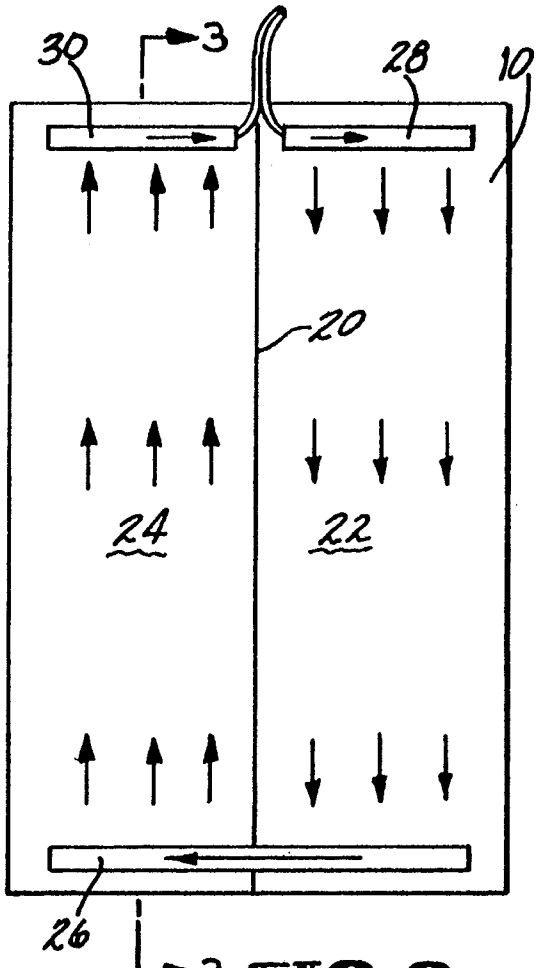
FIG. 2 is an elevational view of a mirror showing a bus arrangement used to supply electrical current to the conductive surface of the mirror assembly in accordance with this invention.

FIG. 2 depicts a typical bathroom size mirror and shows the scribe line 20 running vertically down the entire length of the conductive heating layer thereof to bisect the latter into two adjacent segments 22 and 24. One end of the conductive heating layer has a transfer bus 26 to transfer current from the right segment 22 to the left segment 24. The opposite end of the mirror 10 has two power buses 28 and 30. The bus 30 is connected to the neutral and the bus 28 is connected to the 120 volt line of a standard household electric supply circuit. This effectively makes the current path distance between the power buses 28 and 30 equal to twice the distance between the power buses 28,30 and the transfer bus 26. This arrangement, when wired to a 120 volt power supply, provides the required watts per square foot to heat the mirror.

Obtaining the proper wattage by using scribe line brings up the possibility of arcing across the scribe line if it is not wide enough. There are two possible consequences of this arcing if it occurs. The first is that the arc will be strong enough to cause local heating and fracture of the mirror. The second, and probably more likely, is that the coating will be burned away at the arc site, subsequently extinguishing the arc. This is likely, because the applied voltage is AC, so that the arc extinguishes every 1/120th second if the scribe line is not wide enough. To prevent arcing, the scribe line 20 will be coated with a high dielectric strength epoxy or polyester which has a dielectric strength of 550 volts/mil which will prevent arcing with 1–2 mil width scribe lines. In this high reflectivity embodiment of the invention, the heater component is not used for reflectivity. The heater component is located behind the high reflectivity mirror, thus the scribe lines will not show, and the high reflectivity mirror will assure that the reflective quality is widely acceptable.

Figure 3:
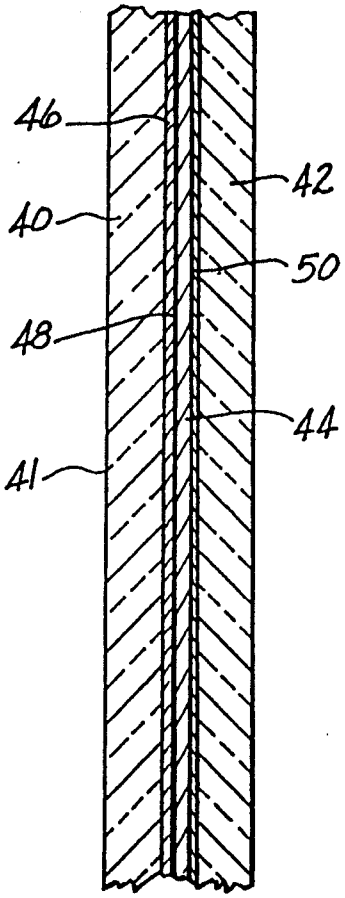
FIG. 3 is a cross-sectional view of the mirror assembly taken along line 3—3 of FIG. 2.

A cross section of the mirror assembly of FIG. 2 is shown on FIG. 3. A one-eighth or one-quarter inch thick mirror 40 and a glass sheet 42 are bonded together with an adhesive 44 after the appropriate buses and the scribe lines are installed. The highly reflective coating 46 of the reflective mirror 40 is covered by a scratch resistant paint layer 48 which faces the adhesive layer 44. The scribed tin oxide conductive heating layer 50 on the rearward glass sheet 42 faces the adhesive layer 44. Placement of the two glass sheets on the outside and the conductive heating layer 50 between them provides the electrical insulation required to meet safety codes. The scratch resistant paint layer 48 on the high reflectivity mirror serves as the dielectric preventing the high resistivity conductor layer 50 (the heater) from touching the low resistivity high reflective layer 46. In addition, further dielectric protection is provided by the adhesive layer 44. These two layers should be very thin (approximately 5 mils) so as not to significantly restrict the heat transfer to the outward facing glass surface 41 of the high reflectivity mirror 40. This is the surface on which fog will form; consequently, heat transfer to this location is very important.

As previously noted, the buses must extend over the entire width of the mirror at both ends, while lying between the two layers of the laminate. In the high reflective embodiment of this invention where the laminate is made up of a reflective mirror and a heater sheet of tin oxide-coated glass, the bus thickness directly affects the heat transfer path length between the heater and the mirror which will directly affect the heating rate.

The degree of contact with the scribed heating reflective surface must be both uniform and intimate. If it is not uniform then the current flow between buses will be non-uniform and the heat input will be non-uniform, which may cause the mirror to crack due to thermal stress. At points where the buses and scribed heating layer are not intimately coupled, the resistance produced will be high, causing local hot spots. In addition, a total wattage will be lowered resulting in an inability of the mirror to remain fog-free.

The bus structure utilized in the mirror assembly of this invention not only fulfills the operational requirements but is also low cost. The bus is formed from foil tapes developed by the 3M Company for use in EMI/RFI shielding for electronic equipment. Two of these tapes, 3M Nos. 1181 and 1345, have both through-plane and in-plane electrical conductive characteristics which are ideal for this application. In addition, they are rated for temperatures in excess of 300 degrees F. (well above the requirement in this application) and are 3 to 4 mils thick. The standard width is ½ inch which provides adequate coupling area with the power source wires. The foil is copper or tinned copper, both of which are ideal for soldering purposes to the power source wires. Application of the tape involves simply cutting it to desired lengths from the roll provided, stripping a backing layer from the tape and applying it to the conductive surface.

Figure 4:
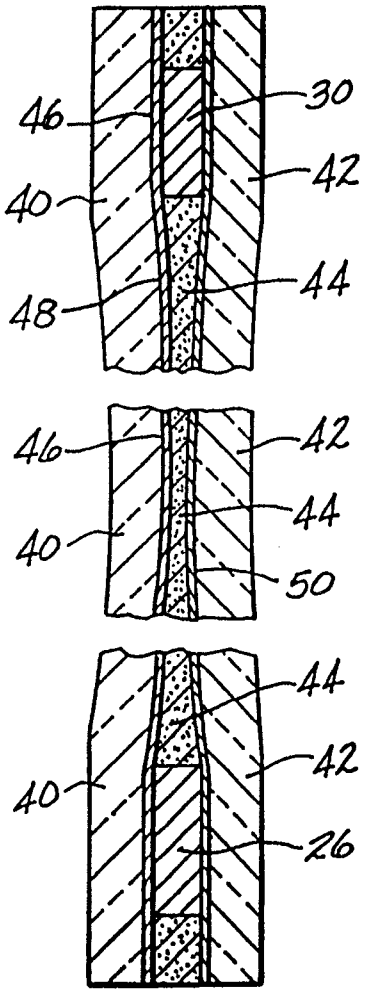
FIG. 4 is a cross-sectional view similar to FIG. 3, but showing in exaggerated proportions, the manner in which continual pressure can be exerted on the conductive bus at all times during continual recycling of the mirror assembly.

An important element to assure good contact through the many thermal cycles demanded by this application is a design feature that maintains a continual pressure on the tape at all times. This may be accomplished by compressing the two glass components 40 and 42 together between the buses as shown in FIG. 4. This is a cross section of the laminate showing the two layers of glass 40 and 42 separated by the two buses 26 and 30. These buses 26 and 30 are 3 to 4 mils thick and will have a 1 to 2 mil polyester or other suitable dielectric film on top of the bus to assure the buses do not contact the high reflectivity surface 46 even though that surface already has a dielectric film in the form of the protective paint 48 used on these household mirrors. This results in a gap of approximately 5 mils. In order to maintain the constant pressure on the buses, the adhesive layer is set to be thinner than 5 mils (1 to 3 mils). When the two glass layers are brought together, pressure sufficient to bend the glass approximately 0.002 in. is applied to the glass surfaces between the buses, essentially bending the glass layers together before contacting the adhesive. Once the adhesive is contacted, the glass components 40 and 42 are held in a permanently bent position which maintains a constant pressure on the buses 26 and 30.

Figure 5:
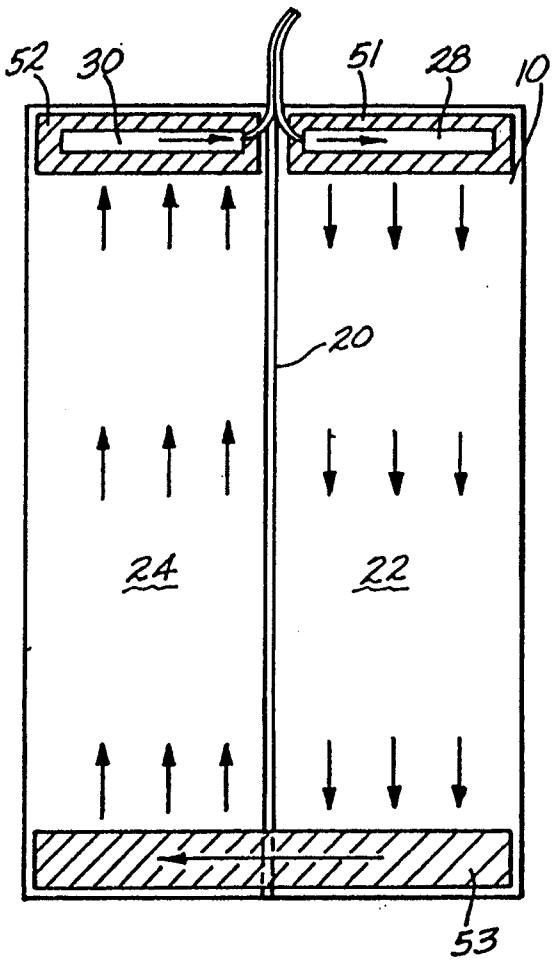
FIG. 5 is an elevational view similar to FIG. 2 but showing an alternative structure for enhancing the electrical contact of the conductive buses, and reducing the amount of bus material needed.

FIG. 5 shows an alternative embodiment of the invention which will enhance the electrical contact between the copper foil tapes 28, 30 and the conductive tin oxide surfaces 22 and 24 on the backing glass layer. This embodiment also eliminates the need to use a copper foil tape as a transfer bus. Layers 51, 52, and 53 are plated layers of silver or copper. The thickness of the plating is in the range of about 0.02 to about 0.20 microns such that the resistivity of the conductive layers 51, 52 and 53 is less than 1 ohm per square. This resistance level permits the elimination of the copper foil transfer bus shown in the earlier figures. Additionally, the superior electrical properties of silver and copper plate, ie, their high conductivity, reduces the contact resistance between the copper foils 28 and 30 and the conductive layers 22 and 24. The plated layers 51, 52 and 53 are sufficiently thin so as not to compromise cost or overall thickness of the composite assembly Additionally, the plated layers are sufficiently malleable to make intimate electrical contact between the uneven surfaces of the foil tapes 28 and 30 and the conductive tin oxide layers 22 and 29.

It will be readily appreciated that the use of a non-reflective conductive heater layer which is disposed adjacent to the rear side of a highly reflective (90% reflectivity) layer will enable the mirror to be made fog-free because the reflective layer is not the heater layer. In such highly reflective mirrors, the reflective layer cannot efficiently serve as a heater layer due to its relatively low resistance.

Since many changes and variations of the disclosed embodiments of the invention may be made without departing from the inventive concept, it is not intended to limit the invention otherwise than as required by the appended claims.

What is claimed is:

1. A fog-resistant mirror assembly usable with conventional household current, said assembly comprising:

a) a mirror glass sheet having a reflective coating thereon;

b) a non-reflective electrically conductive material coating adjacent to a surface of said reflective coating and in heat transfer contact with the latter;

c) a scribe line traversing said conductive material coating to divide the latter into adjacent electrically conductive separate parts, said scribe line being covered with a high dielectric strength material sufficient to prevent arcing across said scribe line;

d) a current-inlet bus connected to one of said conductive material coating parts at one end of said mirror assembly;

e) a current outlet bus connected to an adjacent one of said conductive material coating parts at said one end of said mirror assembly; and f) a current transfer bus connected to both of said conductive material coating parts and spanning said scribe line at an end opposite said one end of said mirror assembly.

2. The mirror assembly of claim 1 wherein said non-reflective electrically conductive material coating is tin oxide.

3. The mirror assembly of claim 1 wherein said inlet and outlet buses are formed from a foil tape having both in-plane and through-plane conductance and combining with said transfer bus and scribe line to increase the current to a length which exceeds the distance between said one and opposite ends of said mirror assembly.

4. The mirror assembly of claim 3 wherein said transfer bus is formed from foil tapes having both in-plane and through-plane conductance.

5. The mirror assembly of claim 3 further comprising plated layers of a malleable electrically conductive metal on said conductive material coating, and sandwiched between said inlet and outlet bus foil tapes and said conductive material coating, and operable to lower the resistance between said inlet and outlet bus foil tapes and said conductive material coating.

6. The mirror assembly of claim 5 wherein said transfer bus is formed from said malleable electrically conductive metal plated on said conductive material coating.

7. The mirror assembly of claim 6 wherein said malleable metal plate is silver, or copper.

8. The mirror assembly of claim 1 wherein said transfer bus is formed from an electrically conductive foil tape having both in-plane and through-plane conductance.

9. A fog-resistant mirror assembly usable with conventional household current, said assembly comprising:

a) a mirror glass sheet having a reflective coating thereon;

b) a non-reflective electrically conductive material coating adjacent to a surface of said reflective coating and in heat transfer contact with the latter;

c) a scribe line traversing said conductive material coating to divide the latter into adjacent electrically conductive separate parts, said scribe line being covered with a high dielectric strength material sufficient to prevent arcing across said scribe line;

d) a foil tape current-conductive inlet bus connected to one of said conductive material coating parts at one end of said mirror assembly;

e) a foil tape current-conductive outlet bus connected to an adjacent one of said conductive material coating parts at said one end of said mirror assembly;

f) a current transfer bus connected to both of said conductive material coating parts and spanning said scribe line at an end opposite said one end of said mirror assembly; and g) plated layers of a malleable electrically conductive metal on said conductive material coating, and sandwiched between said inlet and outlet bus foil tapes and said conductive material coating, and operable to lower the resistance between said inlet and outlet bus foil tapes and said conductive material coating.

10. The mirror assembly of claim 9 wherein said transfer bus is formed from said malleable electrically conductive metal plated on said conductive material coating.

11. The mirror assembly of claim 10 wherein said malleable metal plate is silver, or copper.

* * * * *